US005337112A

United States Patent [19]

Skye et al.

[11] Patent Number: 5,337,112

[45] Date of Patent: Aug. 9, 1994

[54] AUTOMATIC PROCESSING DEVICES FOR PROCESSING PHOTOGRAPHIC MATERIALS

[75] Inventors: David A. Skye, Harpenden; Peter J. Twist, Great Missenden, both of Great Britain

[73] Assignee: Eastman Kodak Company, Rochester, N.Y.

[21] Appl. No.: 910,115

[22] PCT Filed: Jan. 9, 1991

[86] PCT No.: PCT/EP91/00123

§ 371 Date: Jul. 21, 1992

§ 102(e) Date: Jul. 21, 1992

[87] PCT Pub. No.: WO91/10940

PCT Pub. Date: Jul. 25, 1991

[30] Foreign Application Priority Data

Jan. 11, 1990 [GB] United Kingdom ..... 9000620

[51] Int. Cl.[5] ..... G03D 13/00; G03D 3/02

[52] U.S. Cl. ..... 359/298; 354/324

[58] Field of Search ..... 354/298, 324, 297

[56] References Cited

U.S. PATENT DOCUMENTS

| | | | |
|---|---|---|---|
| 3,462,221 | 8/1969 | Tajima et al. | 354/324 |
| 3,515,050 | 6/1970 | Attridge et al. | 354/298 |
| 3,554,109 | 1/1971 | Street et al. | 354/298 |
| 3,680,463 | 8/1972 | Attridge et al. | 354/298 |
| 4,881,095 | 11/1989 | Shidara | 354/298 |

*Primary Examiner*—D. Rutledge
*Attorney, Agent, or Firm*—Frank Pincelli

[57] ABSTRACT

An automatic film processing device replenishment system where an infra red sensor is located to measure silver content of the image on a film or paper carrier, and use the measured silver content for control of replenishment of the process chemicals. In a preferred arrangement a first infra red sensor measures silver content and controls replenishment of developer and bleach and a second infra red sensor measures silver halide content and controls replenishment of fixer.

4 Claims, 1 Drawing Sheet

AUTOMATIC PROCESSING DEVICES FOR PROCESSING PHOTOGRAPHIC MATERIALS

FIELD OF THE INVENTION

The present invention relates to automatic film processing devices for the processing of photographic material.

BACKGROUND OF THE INVENTION

Various kinds of processing machinery are available for processing negative film, for processing colour prints, for processing colour reversal film and for preparing reversal prints.

In general the process involves developing a silver image then oxidising the silver in a bleaching stage followed by removimg the silver in a fixing stage. These stages occur in all normal photographic processes, whether black and white, or colour and whether negative or reversal processing; although further stages will be required in the case of reversal processing, and dye coupling during development in the case of colour processing.

In automatic processing systems, ingredients are taken up in the various stages of processing, and therefore the various processing baths need replenishment of their constituents in order to keep them at the correct consistency.

Automatic replenishment systems have been proposed previously in which the strength of the developed dye image is measured and this is then used to determine the rate of replenishment of the various ingredients. U.S Pat. Nos. 4,057,818 and 3,554,109 describe such systems.

In these systems dye density is measured after the film is fully processed in order to assess the replenishment needs.

These methods therefore give rise to a degree of inaccuracy since the amount of dye in the final image is not necessarily a direct function of the total amount of developing agent consumed in forming the final image.

The present invention directs itself to this problem and aims to provide an improved method of assessing the replenishment need.

SUMMARY OF THE INVENTION

Accordingly the present invention provides an automatic film processing device for photographic materials including at least one developing station to develop an image including silver on a carrier substrate, and at least one station for bleaching and removing the silver to provide a fixed image on said carrier substrate, an infra red sensing device for measuring the need for replenishment and replenishment means for replenishment of developer chemicals in dependence on the measured need for replenishment, characterised in that the infra red sensing device is located at a position prior to removal of the silver and is arranged to measure the density of silver in the developed image on the carrier substrate in order to provide a measure of the replenishment need.

Accordingly the infra red sensing device will normally be provided immediately after the developing station and prior to the bleaching and fixing station or stations.

The measurement of silver can be used for control of replenishment of developer, bleacher and fixer; however replenishment of fixer can be more accurately controlled by measurement of silver halide.

Accordingly a second feature of the present invention is provision of a second infra red sensing device which is located to measure silver halide content-of said carrier substrate, and thereby to control replenishment of fixer. In such a case the first infra red sensing device controls replenishment of developer and bleacher chemicals.

The carrier substrate may be a negative or transparency film base or it may be a paper base for colour prints.

In the case of colour processing, measurement of the amount of developed silver in situ during development is particularly accurate since the amount of colour developing agent consumed and the amount of bromide ion released in the development reaction is proportional to the amount of silver developed. This means that the replenishment need for any film can be accurately assessed from the average developed silver level.

On the other hand in the prior art processes where dye density is measured, this measurement is less accurate because the dye to silver ratio can vary for different film types and from different manufacturers. The reason for this variation is that not all the oxidised colour developing agent generated during silver development goes to form dye. A variable proportion of colour developing agent undergoes side reactions such as sulphonation and deamination.

Different films contain couplers of different activity which means they have different abilities to consume colour developing agent. If colour developing agent is not consumed it does not form dye and is lost in one or other of the side reactions mentioned above. Because of this the dye to silver ratio is variable and so dye density does not necessarily reflect silver development or replenishment needs accurately.

In addition different films contain different silver levels although the dye density aim is similar. Thus to use dye density to assess replenishment needs would require a knowledge of the actual film type, and this is unnecessary if silver is measured directly.

Dye density will depend on the measurement apparatus and the optical filters used and also on the hue of the dye in the film. The dye and dye hue also vary from film to film and between manufacturers. This will cause further inaccuracy in assessing replenishment needs by means of dye density measurement.

Coloured couplers are used in most colour negative films to provide some compensation for the unwanted absorption of the image dyes. To make this compensation, the colour of the coupler is destroyed by coupling with colour developing agent as the image dye is formed. Thus there will be a variable colour and amount of coloured coupler necessary depending on the amount of unwanted absorption. This factor will again confuse the relationship between average dye density and amount of developed silver and thus upset the assessment of replenishment based on average dye density.

Some of the dye density in the minimum density areas can be due to retained sensitized dyes and not image dyes or coloured couplers. This would be measured as part of the average dye density but would be unrelated to developed silver and also to replenishment needs.

The replenishment of the bleach bath is also directly related to the amount of silver it has to remove from the film. Again the replenishment needs are not accurately assessed from dye density because of the variable dye to silver ratio in different films.

In addition there is the fixer bath, which removes silver halide that was originally unused in the development and also silver halide regenerated in the bleach bath. In this case also the replenishment need is entirely unrelated to the average dye density. A second infra red monitor can be used to measure total silver halide and so it can provide an accurate assessment of the silver load in the fixer bath and therefore its replenishment needs.

DESCRIPTION OF THE DRAWINGS

An embodiment of the invention will now be described by way of example with reference to the accompanying diagrammatic drawings in which.

DETAILED DESCRIPTION OF THE INVENTION

Figure 1:
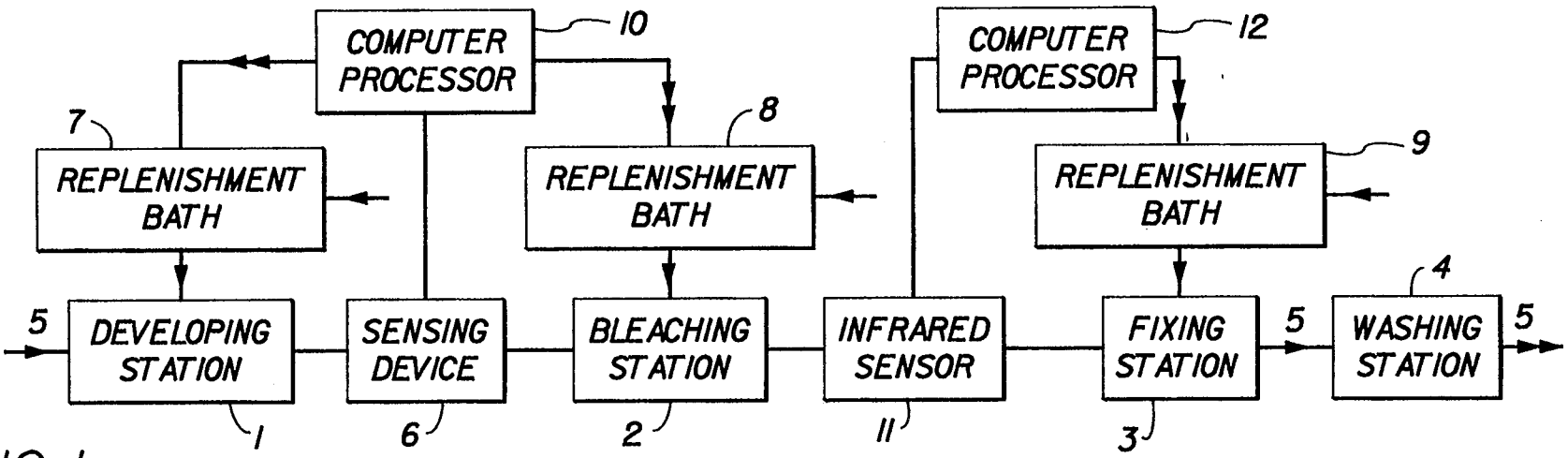
FIG. 1 is a schematic block diagram of a film processor unit.

Referring to FIG. 1, a film processor unit essentially comprises stations 1 for developing, 2 for bleaching, 3 for fixing and 4 for washing of a film which passes along the path 5 through each of the baths in turn. The process uses standard processing chemicals such as the Kodak C41 process ingredients. Located between the developer station 1 and the bleaching station 2 is a first infra red sensing device 6 which is shown in detail in FIG. 2. Replenishment baths 7, 8 and 9 provide replenishment chemicals to the developing station 1, the bleaching station 2 and the fixing station 3 respectively.

The first infra red sensing device 6 is located to measure the silver content of the film and to provide a signal via computer processor 10 for control of replenishment of the baths 7 and 8 for replenishnent of the developer and bleach solutions.

A second infra red sensing device 11 is located between the bleaching station 2 and the fixing station 3, so as to measure the silver halide content of the film and provide a signal via computer processor 12 for control of replenishment of the fixer to fixing station 3.

Two alternative locations for the second infra red sensing device 11 are in the bleaching tank 2 or prior to the developing station 1, where in each case a measure of silver halide content can be made.

The replenishment system in each case is shown in its simplest form, namely a tank feeding replenishment chemicals straight into the respective bath, but in practice in many commercial operations such a system would be more complex. Often, an overflow, regeneration, mixing and recharging circuit would be employed and this is well known in the art.

As previously mentioned, the processor is a conventional multi-tank system for carrying out the Kodak process C41. This is for development of colour negative film. A critical feature of the invention is that the infra red detector is located immediately after the developing station so that it can monitor the developed silver image in order to control replenishment.

There are several other processes where the invention is equally applicable. In each of these other processes the same basic process steps of developing then bleaching then fixing arise, whether in processing colour prints (the Ekta print 2 process) or in processing colour reversal film (the process E6) where additional steps to cause reversal take place or in reversal processing of prints, i.e. prints from transparencies (the process R3). In each of these cases the important factor is to locate the first infra red detector at a point after the development stage but before removal of the silver, and to locate the second infra red detector at a point where silver halide can be measured.

Figure 2:
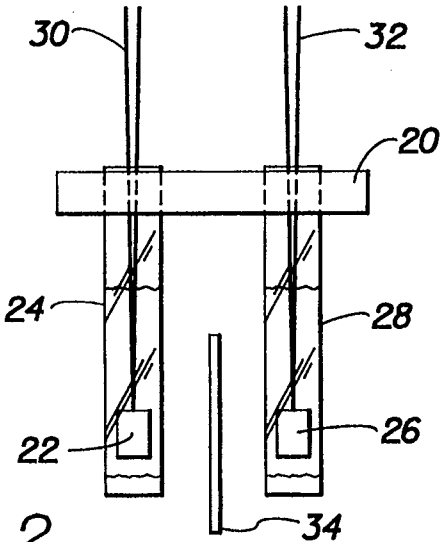
FIG. 2 shows an infra red sensing device.

Referring now to FIG. 2, this shows the device 6 for sensing the infra red density of the metallic silver in the film after development. The second infra red sensing device is of a similar structure.

The device comprises a support 20 which carries an infra red emitting diode (LED) 22, and an infra red photodiode detector 26. The LED 22 and the detector 26 are sealed in respective transparent plastics tubes 24, 28 and they are spaced apart by the support 20 as shown. Film 34 travelling along path 5 is arranged to pass close to the detector 26 so that the infra red density sensed by the amount of radiation passing from the LED 22, through the film 34, and on to the detector 26, approximates to the diffuse density of the film. The absolute value of the density is unimportant.

The LED 22 is driven at a constant current from a power supply (not shown) by means of connections 30. The detector 26 is spectrally matched to the LED 22. The wavelength of the infra red radiation emitted by the LED 22 is around 950 nm.

The detector 26, when operating in its linear short circuit current mode, produces a signal which represents transmission of infra red radiation through the film 34. The signal from the detector 26 is converted to a density value by a monolithic logarithmic amplifier (not shown) to provide an output signal which corresponds to the density value. This signal is monitored by its computer processor 10 (see FIG. 1) through connections 32 and is processed to provide control for replenishment. Thus, signals from the computer 10 can then be fed to each of the replenishment tanks 7 and 8 (these signals are shown as double arrows.

In the same way the signal from the second infra red detector 11 is fed via its computer processor 12 to the fixer replenishment tank 9.

Thus, by measurement of the average silver and silver halide density of a particular film, the amount this varies from a predetermined norm can be used to vary the amount of replenishment chemical fed into each of the processing stages 1, 2 and 3.

For example it is known that for Kodak VR100 film the usage rates at an average customer density are as follows:

| COMPONENT | USAGE RATE (g/ft.) |
|---|---|
| CD4 | 0.01 |
| NaBr | −0.0045 |
| K2S03 | 0.0031 |
| HAS | 0.0024 |
| pH | 0.0011 units/ft |

If then the measured density of the film is greater than the expected average or less than that expected average all these component usage rate measurements are adjusted on a pro rata basis. This enables the correct quantity of developing agent replenishment rate to be achieved, and similarly the replenishment of the bleaching and fixing stations can be adjusted.

While the block diagram schematic arrangement shows a single control to each of the replenishment tanks, it is possible to design more complex arrangements where individual components are individually adjusted at different rates.

The main advantages of carrying out the invention are as follows:

1. The actual silver densities for each film are obtained as opposed to some overall trade average. This means that the replenishment calculated from these values applies directly to that film and is therefore likely to be more accurate.

2. The type of film does not have to be determined because average density differences from film type to film type are automatically measured. This means that there is no need for the operator to do complex sums to determine the average film-type-mix that is being processed in order to calculate the correct replenishment rate.

3. High exposure or low exposure films with non standard densities are correctly assessed.

4. Variable amounts of end fogging are automatically accounted for.

5. The system is fully self-contained and can be part of an automatic replenishment control mechanism which will enable the use of low effluent chemistry and at the same time give improved process control.

6. If this system is sufficiently accurate it might be possible to dispense with control strips or at least to reduce the frequency of their use and thus provide a cost saving to the user.

We claim:

1. An automatic film processing device for treating photographic material including:

at least one developing station for developing a silver image on a carrier substrate;

at least one station for converting metallic silver to silver halide and for dissolving silver halide to provide a fixed image on the carrier substrate;

an infra red sensing device for measuring a parameter of the process, the infra red sensing device being located at a position immediately after the developing station and prior to any subsequent station and is arranged to measure the density of the silver in the developed image on the carrier substrate; and replenishment means for effecting replenishment of developer chemicals according to measurement of the density of the silver in the developed image on the carrier substrate to provide a measure of the replenishment need;

characterized in that the device further comprises a second infra red sensing device located to measure silver halide in the carrier substrate to provide a signal for control of the replenishment of the at least one station for dissolving silver halide to provide a fixed image on the carrier substrate.

2. A device according to claim 1, wherein the at least one station for converting metallic silver to silver halide and for dissolving silver halide to provide a fixed image on the carrier substrate comprises a bleaching station for converting metallic silver to silver halide and a fixing station for dissolving silver halide, the second infra red sensing device being positioned prior to the fixing station.

3. A device according to claim 1, wherein the at last one station for converting metallic silver to silver halide and for dissolving silver halide to provide a fixed image on the carrier substrate comprises a bleaching station for converting metallic silver to silver halide and a fixing station for dissolving silver halide, the second infra red sensing device being position in the bleaching station.

4. A device according to claim 1, wherein the second infra red sensing device is located prior to the at least one developing station.

* * * * *